US011891811B2

(12) United States Patent
Warner

(10) Patent No.: US 11,891,811 B2
(45) Date of Patent: Feb. 6, 2024

(54) WALL SYSTEM WITH FULCRUM RELEASE AND REPLACEABLE UNITS

(71) Applicant: NINE O, LLC, Draper, UT (US)

(72) Inventor: Scott K. Warner, Draper, UT (US)

(73) Assignee: NINE O, LLC, Draper, UT (US)

( * ) Notice: Subject to any disclaimer, the term of this patent is extended or adjusted under 35 U.S.C. 154(b) by 212 days.

(21) Appl. No.: 17/145,179

(22) Filed: Jan. 8, 2021

(65) Prior Publication Data

US 2021/0131117 A1 May 6, 2021

Related U.S. Application Data

(63) Continuation of application No. 16/501,130, filed on Aug. 30, 2019, now abandoned.

(51) Int. Cl.
*E04F 13/072* (2006.01)
*E04F 13/08* (2006.01)
(Continued)

(52) U.S. Cl.
CPC ..... *E04F 13/072* (2013.01); *A47B 21/00* (2013.01); *A47B 88/00* (2013.01); *A47B 96/027* (2013.01);
(Continued)

(58) Field of Classification Search
CPC ..... E04F 13/072; E04F 13/0801; E04F 13/09; E04F 13/26; E04F 13/21; E04F 13/07; E04F 13/0862; E04F 13/0871; A47B 96/027; A47B 5/02; A47B 57/08; A47G 2001/0666
See application file for complete search history.

(56) References Cited

U.S. PATENT DOCUMENTS 3,704,675 A * 12/1972 Bellasalma ..... A47B 96/063 248/222.51
5,813,741 A * 9/1998 Fish ..... F25D 25/024 312/351
6,467,210 B1 * 10/2002 Chang ..... A47G 25/06 40/792
(Continued)

FOREIGN PATENT DOCUMENTS

CA 2310869 A1 * 12/2000 ..... A47B 96/027
CA 2694846 A1 * 11/2010 ..... A47B 57/30
(Continued)

OTHER PUBLICATIONS

Translation for DE 102017119951 A1. (Year: 2019).*

*Primary Examiner* — Michael Safavi
(74) *Attorney, Agent, or Firm* — Workman Nydegger

(57) ABSTRACT

A reconfigurable wall panel system configured to enable rapid attachment and removal of a wide range of interchangeable wall units and accessories is disclosed. One or more embodiments comprise a reconfigurable wall panel having a wall frame with one or more design spaces, each design space having opposing upper and lower grooves and a depression serving as a fulcrum for insertion of interchangeable wall units. Embodiments of interchangeable wall units may include one or more facing features, as well as upper and lower edges corresponding to the opposing upper and lower grooves of the one or more design spaces, the interchangeable wall units being configured to tilt into the depression and slide into a removably secured position within the respective design space.

20 Claims, 17 Drawing Sheets

(51) Int. Cl.

| | |
|---|---|
| ***A47B 21/00*** | (2006.01) |
| ***A47G 1/06*** | (2006.01) |
| ***A47B 88/00*** | (2017.01) |
| ***A47B 96/02*** | (2006.01) |

(52) U.S. Cl.
CPC ..... *A47G 1/065* (2013.01); *E04F 13/0801* (2013.01); *E04F 13/0862* (2013.01); *E04F 13/0871* (2013.01)

(56) References Cited

U.S. PATENT DOCUMENTS

| | | | | |
|---|---|---|---|---|
| 9,700,134 | B1 * | 7/2017 | Simpson, II | A47B 96/025 |
| 10,697,183 | B1 * | 6/2020 | Ferguson | E04F 13/083 |
| 2009/0236482 | A1 * | 9/2009 | Winig | A47B 57/408 248/220.43 |
| 2013/0180202 | A1 * | 7/2013 | Woods | E04F 19/062 52/710 |
| 2014/0157701 | A1 * | 6/2014 | Jedia | E04F 13/12 52/384 |
| 2014/0198490 | A1 * | 7/2014 | Halseth | A47B 96/027 362/147 |
| 2014/0251933 | A1 * | 9/2014 | Old | A47F 5/0018 211/90.04 |

FOREIGN PATENT DOCUMENTS

| | | | | |
|---|---|---|---|---|
| CA | 2810506 | A1 * | 6/2013 | A47F 5/0018 |
| CH | 338164 | A * | 4/1959 | A47B 57/08 |
| CN | 112252632 | A * | 1/2021 | E04F 13/072 |
| CN | 112554470 | A * | 3/2021 | E04F 13/072 |
| CN | 112780038 | A * | 5/2021 | E04F 13/072 |
| DE | 202012100136 | U1 * | 6/2013 | A47G 1/0605 |
| DE | 202012012502 | U1 * | 7/2013 | E04F 13/0801 |
| DE | 102017119951 | A1 * | 2/2019 | E04F 13/072 |
| DE | 202019105878 | U1 * | 1/2020 | A47B 96/027 |
| EP | 2238867 | A2 * | 10/2010 | A47B 96/027 |
| GB | 2348597 | A * | 10/2000 | A47B 57/20 |
| GB | 2574799 | A * | 12/2019 | E04B 1/003 |
| KR | 2001065925 | A * | 7/2001 | A47B 57/08 |
| KR | 1625215 | B1 * | 6/2016 | A01G 9/025 |
| KR | 2016149652 | A * | 12/2016 | E02D 17/20 |
| KR | 2017000587 | U * | 2/2017 | E04F 13/0801 |
| KR | 2018002749 | U * | 9/2018 | E04F 13/0801 |
| WO | WO-9402050 | A1 * | 2/1994 | A47B 96/063 |
| WO | WO-2011150309 | A2 * | 12/2011 | A47B 96/027 |
| WO | WO-2014043805 | A1 * | 3/2014 | E04F 13/072 |
| WO | WO-2019169439 | A1 * | 9/2019 | A47B 47/0075 |

* cited by examiner

WALL SYSTEM WITH FULCRUM RELEASE AND REPLACEABLE UNITS

CROSS-REFERENCE TO RELATED APPLICATIONS

This application is a continuation of U.S. application Ser. No. 16/501,130, filed Aug. 30, 2019, and entitled "WALL SYSTEM WITH FULCRUM RELEASE AND REPLACEABLE UNITS," the entire content of which is incorporated herein by reference.

BACKGROUND OF THE INVENTION

1. Technical Field

The present disclosure relates to wall treatments, namely reconfigurable wall panels with interchangeable units.

2. Background and Relevant Art

Conventional mechanisms for adding treatments to a wall include attaching components to a wall with hooks, fasteners, and more complicated framing systems. Wall systems that employ frames, such as slat walls or French cleating, tend to require sliding of the component within a grooved space and pulling the component outward. Without a substantial grip on the component, this can be difficult. Also, such systems often offer relatively weak or instable support to the various attached componentry. A light bump in an upward direction can easily dismount a component. Other attachments mechanisms tend toward the permanent, making the modularity of wall design either too simplistic or too rigid for easy, rapid changes and generally require tools for installation or removal of components and accessories.

In the field of retail stores, for example, wall systems are frequently employed for organizing and displaying offered goods alongside advertisements and other various decoration designed to direct consumers towards products and offerings. Such wall systems generally include slat walls, pegboards, French cleating, or similar means for mounting and or hanging shelves, waterfall hangers, display cases, and so forth. Some of the available wall systems are difficult to assemble and maintain, while others are not aesthetically pleasing and of poor durability.

Accordingly, there are a number of disadvantages with wall treatments and wall panel systems that can be addressed.

BRIEF SUMMARY OF THE INVENTION

Embodiments of the present disclosure comprise systems, methods, and apparatus that enable rapid attachment and removal of a wide range of units within a wall system. In particular, a reconfigurable wall panel system can be configured to enable rapid attachment and removal of a wide range of interchangeable wall units and accessories. One or more embodiments comprise a reconfigurable wall panel having a wall frame with one or more design spaces, each with opposing upper and lower grooves or channels and a depression serving as a fulcrum for insertion of interchangeable wall units. Embodiments of interchangeable wall units may include one or more facing features, as well as upper and lower edges or grooves corresponding to the opposing upper and lower grooves or channels of the one or more design spaces, the interchangeable wall units being configured to tilt into the depression and slide into a removably secured position within the respective design space.

For example, a reconfigurable wall panel can comprise a wall frame having one or more design spaces, each design space comprising opposing upper and lower grooves; and a depression within the design space, the depression enabling a fulcrum action in combination with the opposing upper and lower grooves; and one or more interchangeable wall units configured to insert in the one or more design spaces, each interchangeable wall unit comprising: opposing upper and lower edges corresponding to the upper and lower grooves of each design space, the interchangeable wall unit being configured in size and shape to tilt into the depression of each design space and slide into a position such that the upper and lower edges of the interchangeable wall unit cooperate with the upper and lower grooves of each design space to removably secure the position of the interchangeable wall unit; and one or more facing features.

Reconfigurable wall panels can comprise one or more wall frames, each wall frame having a plurality of design spaces, each design space comprising opposing upper and lower grooves; and a depression within the design space, the depression enabling a fulcrum action in combination with the opposing upper and lower grooves; and one or more interchangeable wall units configured to insert in the one or more design spaces, each interchangeable wall unit comprising opposing upper and lower edges corresponding to the upper and lower grooves of each design space, the interchangeable wall unit configured in size and shape to tilt into the depression of each design space and slide into a position such that the upper and lower edges of the wall unit cooperate with the upper and lower grooves of the design space to removably secure the position of the interchangeable wall unit; and one or more facing features.

A reconfigurable workstation can comprise a wall frame configured to be secured to an existing wall or structure, the wall frame having a plurality of design spaces, each design space comprising opposing upper and lower grooves; and a depression within the design space, the depression enabling a fulcrum action in combination with the opposing upper and lower grooves; and a desk unit configured to selectively mount to two or more of the plurality of design spaces, the desk unit comprising a rear surface comprising two or more mounting panels configured to insert in two or more of the plurality of design spaces, each mounting panel comprising opposing upper and lower edges corresponding to the upper and lower grooves of each design space, each mounting panel configured in size and shape to tilt into the depression of the design space and slide into a position such that the upper and lower edges of the mounting panel cooperate with the upper and lower grooves of the design space to removably secure the position of the mounting panel; and a work surface extending away from the rear surface, the work surface being substantially perpendicular to the rear surface.

This summary is provided to introduce a selection of concepts in a simplified form that are further described below in the detailed description. This summary is not intended to identify key features or essential features of the claimed subject matter, nor is it intended to be used as an indication of scope of the claimed subject matter.

Additional features and advantages of exemplary embodiments of the disclosure will be set forth in the description which follows, and in part will be obvious from the description, or may be learned by the practice of such exemplary embodiments. The features and advantages of such embodiments may be realized and obtained by means of the instruments and combinations particularly pointed out in the appended claims. These and other features will become more fully apparent from the following description and appended claims, or may be learned by the practice of such exemplary embodiments as set forth hereinafter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Figure 1:
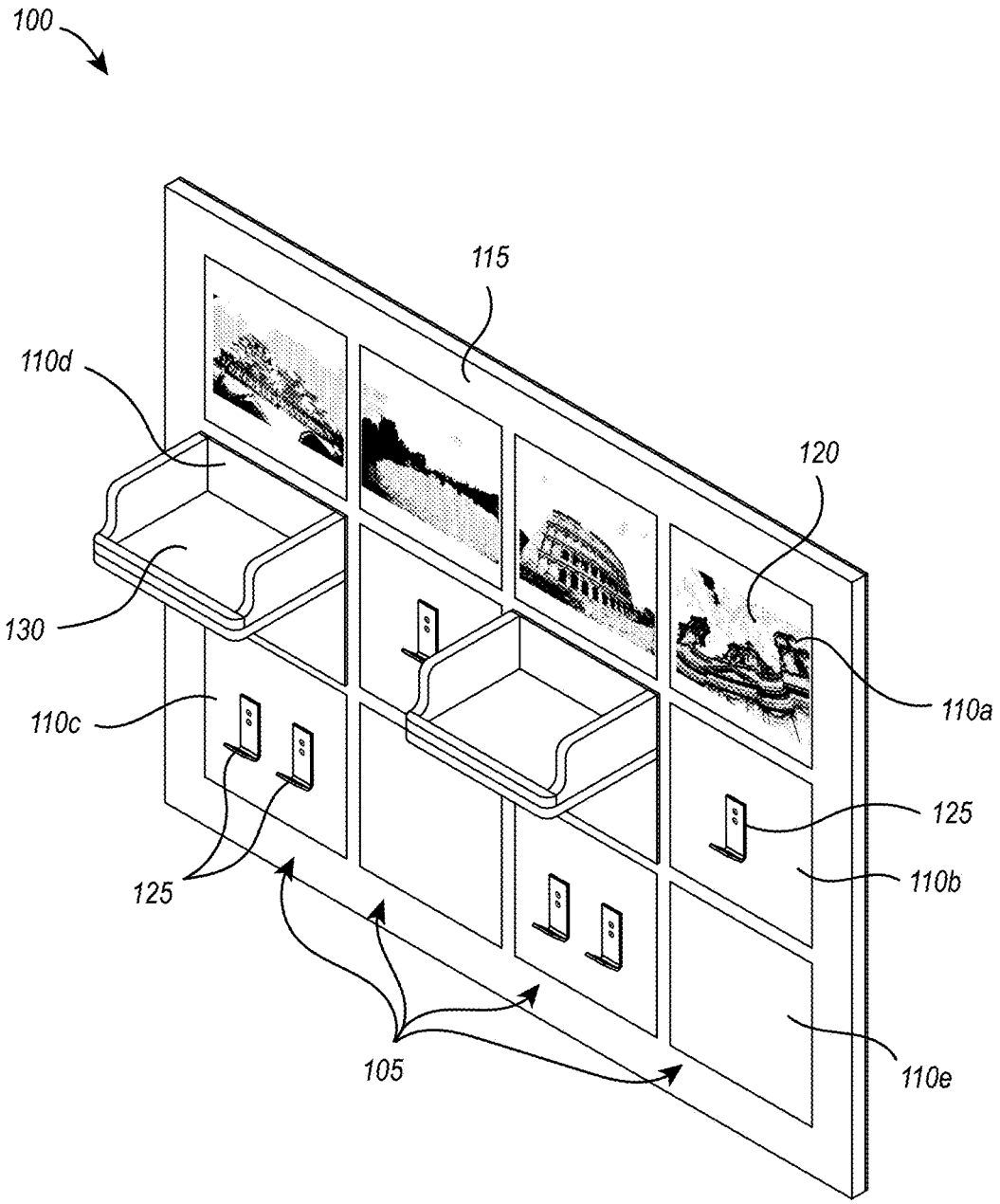
FIG. 1 illustrates a front perspective view of a reconfigurable wall panel with multiple design spaces and various interchangeable wall units according to one or more embodiments of the present disclosure.

The present invention extends to systems, methods, and apparatus that enable rapid attachment and removal of a wide range of units within a wall system. In particular, a reconfigurable wall panel system can be configured to enable rapid attachment and removal of a wide range of interchangeable wall units and accessories. One or more embodiments comprise a reconfigurable wall panel having a wall frame with one or more design spaces, each with opposing upper and lower grooves or channels and a depression serving as a fulcrum for insertion of interchangeable wall units. Embodiments of interchangeable wall units may include one or more facing features, as well as upper and lower edges or grooves corresponding to the opposing upper and lower grooves or channels of the one or more design spaces, the interchangeable wall units being configured to tilt into the depression and slide into a removably secured position within the respective design space.

One will appreciate in view of the present disclosure and claims that a reconfigurable wall panel can comprise a wall frame with a combination of grooves within at least one design space or window for holding and securing a wall unit. In at least one embodiment, the design space or window comprises at least one depression that enables a fulcrum action for inserting and removing the wall unit. This can allow a user to easily remove a wall unit in a design space by lifting the wall unit, leaning a portion of the wall unit into the depression in a fulcrum action, and sliding the unit out and away from the design space. The user can employ a similar action to install the same or another wall unit into the design space.

These and other features of the reconfigurable wall panels and systems disclosed herein enable a user to employ a system that is not dependent on the flexibility or malleability of the inserted material. In other words, rigid materials of desirable finishes can be employed with the systems disclosed herein, resulting in a more durable, more aesthetic, and more easily usable wall system compared to currently available wall systems.

Additionally, reconfigurable wall panels and systems of the present disclosure can easily be mounted to an existing wall or structure, implemented as part of a newly built wall or structure, or integrated with a movable unit for increased versatility. Some embodiments, for example, comprise a wall panel or frame of a single piece that can easily be mounted to an existing structure using common hardware such as screws, nails, or bolts. Some embodiments also include threaded inserts and threaded bolts for further securing interchangeable wall units to design spaces. Further, embodiments of reconfigurable wall panels include frames of various sizes and for various applications, such as, for example, decorative panels, functional panels, small panels comprising as little as one design space, large panels with multiple design spaces, panels spanning a small space, and panels spanning a significant portion of or an entire wall.

Interchangeable wall units of the present disclosure can include an almost endless variety of functional and decorative features facing forward when the wall unit is mounted within a corresponding design space. For example, a wall unit may be as simple as a finishing panel designed to occupy a design space that is not otherwise in use. Examples of finishing panels include panels built of the same material as the wall frame, panels comprising any color, graphic, image, or design selected by a user or designer, panels consisting of photograph prints, and so forth. Accordingly, virtually any design of aesthetic wall unit can be designed or adapted to be secured within a design space.

Embodiments of the present disclosure also include any number of functional wall units configured to interchangeably mount to a reconfigurable wall panel or system. For example, embodiments of functional wall units can include hanging features such as but not limited to hooks, pegs, knobs, hangers, or racks. Additionally or alternatively, functional wall units can include corkboards, pegboards, whiteboards, French cleating, shelves, cabinets, drawers, desks, tables, dressers, bicycle racks, appliances, and anything to which attachment mechanisms of the present disclosure can be secured. One skilled in the art would appreciate that reconfigurable wall panels according to the present disclosure can be implemented in a wide range of functional applications and aesthetic designs.

Referring now to the Figures, FIG. 1 illustrates a reconfigurable wall panel 100 with multiple design spaces 105 and various interchangeable wall units 110 according to one or more embodiments of the present disclosure. As shown, reconfigurable wall panel 100 comprises a wall frame 115 having multiple design spaces 105, each design space 105 having one interchangeable wall unit 110 attached thereto.

While the illustrated design spaces 105 each comprise a generally square shape, embodiments of the present disclosure can include any shape that complements (or at least does not interfere with) the mechanisms disclosed herein for attachment and removal of wall units 110 within design spaces 105. Also, embodiments of the present disclosure can include design spaces 105 and corresponding interchangeable wall units of virtually any size, such as but not limited to 5 inches by 5 inches, 8 inches by 8 inches, 12 inches by 12 inches, as well as smaller or larger sizes, with the corresponding dimensions of the embodiment adjusted to achieve the functionalities disclosed herein.

Some embodiments of interchangeable wall units 110 have front facing features that are either decorative or functional in nature. For example, interchangeable wall unit 110*a* is shown with a photographic image 120 printed thereon. Some embodiments include a photographic image 120 printed directly onto interchangeable wall unit 110*a*, and some embodiments include a photographic image 120 printed on fabric, paper, or similar material and covered by an acrylic, glass, or otherwise transparent panel. One should appreciate that various other artistic designs can be implemented in like manner, such as but not limited to paintings, graphical designs, colored prints, wallpaper, a textured surface, and so forth.

Also shown is interchangeable wall unit 110*b* having a hook 125 for hanging coats, keys, bags, or any items one may desire to hang in place. Interchangeable wall unit 110*c* is shown with multiple hooks 125 on a single unit. In some embodiments, interchangeable wall units 110 can include shelving or cabinetry configured to support various items, included items of significant weight. For example, interchangeable wall unit 110*d* is shown having a shelf 130. Additionally, some embodiments of interchangeable wall units 110 can simply comprise a feature or surface for covering one or more of design spaces 105, such as the illustrated interchangeable wall unit 110*e*, comprising a planar face plate.

While the illustrated wall frame 115 has exactly twelve design spaces 105, embodiments of the present disclosure can include less or more design spaces 105. Further, while the illustrated wall frame 115 comprises a rectangular shape with the design spaces 105 arranged in rows and columns, embodiments of the present disclosure can take on any desired arrangement of design spaces 105 to form any desired shape of wall frame 115, such as but not limited to geometric shapes (e.g., circles or pyramids), letters or numbers, and icon shapes (e.g., hearts or trees).

Figure 2:
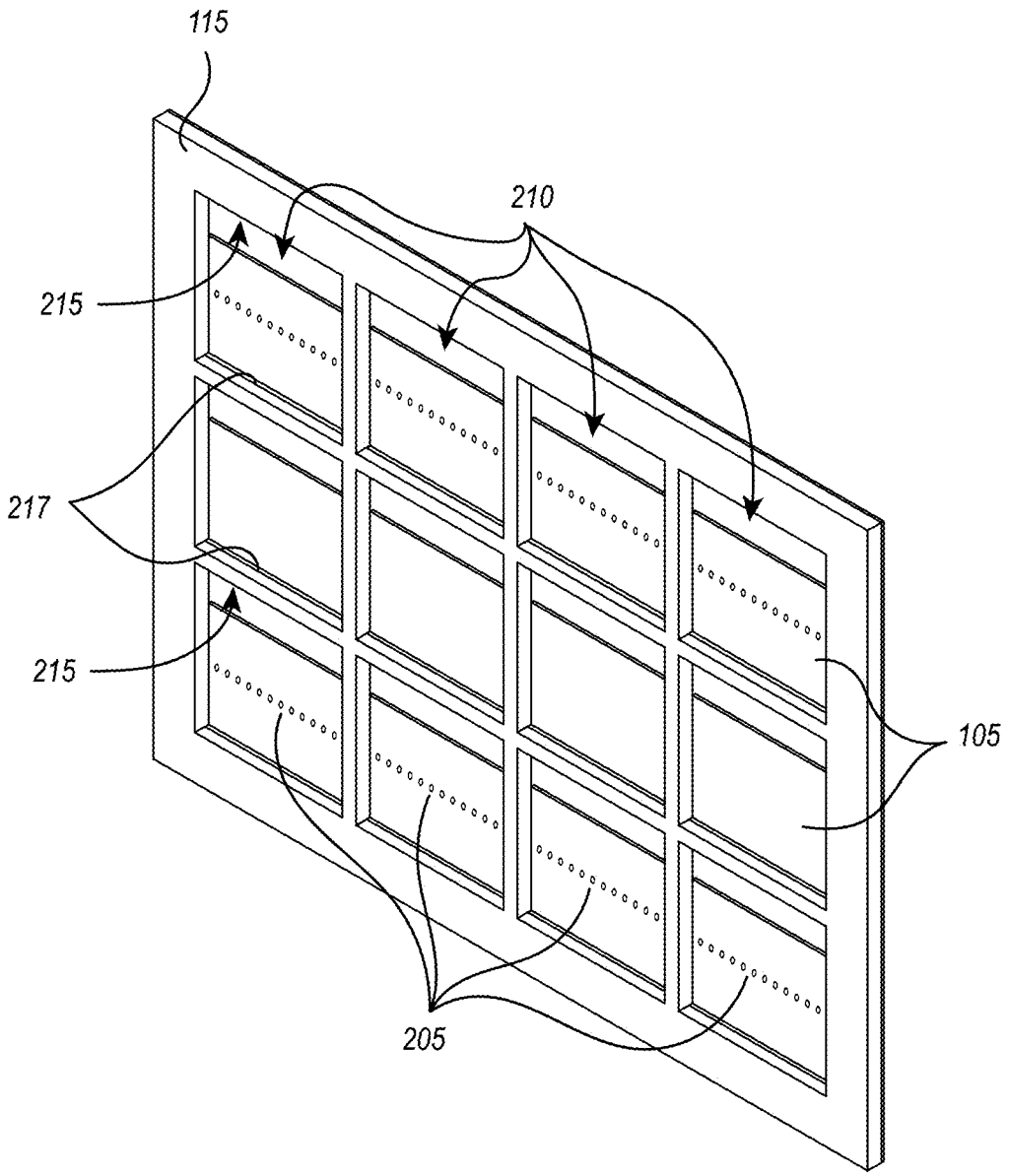
FIG. 2 illustrates a front perspective view of the reconfigurable wall panel of FIG. 1 with the various interchangeable wall units removed.

FIG. 2 illustrates an embodiment of wall frame 115 with interchangeable wall units 110 removed, leaving each design space 105 empty. Some embodiments of wall frame 115 include simplified means for mounting wall frame 115 to an existing wall or structure. In the embodiment illustrated, a plurality of mounting holes 205 are provided to enable easy installation using screws, bolts, or other mounting hardware directly to, for example, a structural wall (e.g., a weight bearing wall), or divider wall. Embodiments of wall frame 115, however, can be mounted in any suitable manner, or can be left unmounted (e.g., leaning against, or hung on a wall). Some embodiments can include fewer mounting holes 205 than illustrated, while others can include more mounting holes 205, or no mounting holes 205, allowing the user/installer more flexibility. As illustrated, some embodiments can include circular mounting holes 205, each configured to receive a single screw, bolt, or other mounting hardware. Alternatively or additionally, embodiments can include elongated holes (i.e., slotted or pill shaped holes) to offer additional flexibility in the placement and quantity of corresponding mounting hardware during installation. In at least one embodiment, a wall unit, a wall frame, or both, can be configured with a liquid level or other leveling mechanism built therein, to ensure proper leveling of the wall frame and/or wall unit.

With interchangeable wall units 110 removed, each design space 105 in FIG. 2 is shown as vacant with the mechanisms enabling selective attachment and removal of interchangeable wall units 110 are uncovered. In some embodiments, each design space 105 comprises a depression 210 along an upper and/or lower portion of the design space 105, which provides a lever or fulcrum area that enables release or insertion of an interchangeable wall unit 110. Some embodiments also comprise upper and lower grooves or channels 215, 217, each groove/channel 215, 217 configured to receive corresponding grooved edges of any interchangeable wall unit 110, as shown in more detail in FIGS. 5A-10B.

As further understood, wall units 110 themselves may be configured to insert within the one or more groove/channels 215, 217 of a design space 105, or otherwise be configured with corresponding grooved or flanged edges, which cooperate to secure wall unit 110 on or within grooves/channels 215, 217 of design space 105. In some embodiments, grooves/channels 215, 217 can also enable insertion of a finishing panel, photograph, or the like to cover design space 105 for a more desirable finish when a particular design space 105 is not in use with a function wall unit 110.

Figure 3:
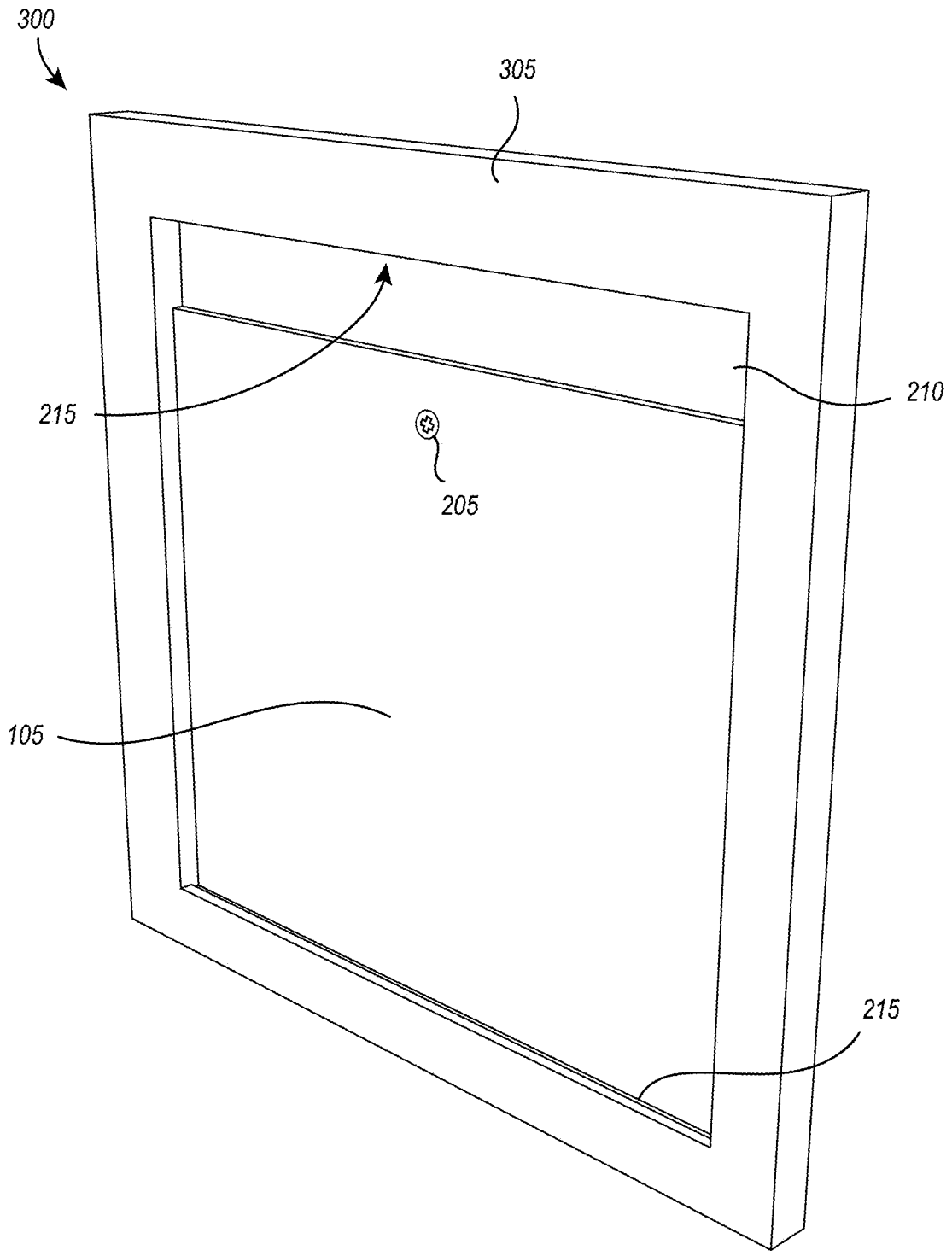
FIG. 3 illustrates an exploded, front perspective view of a reconfigurable wall panel with a single design space according to one or more embodiments of the present disclosure.

Some embodiments of reconfigurable wall panels can comprise any number of design spaces 105, such as but not limited to a single design space 105, as illustrated in FIG. 3. As shown, a reconfigurable wall panel 300 comprises a wall frame 305 with a single design space 105, to which any interchangeable wall unit 110 configured to correspond with a single design space 105 may be selectively secured. Various examples of such interchangeable wall units 110 are provided herein, such as interchangeable wall units 110*a*-110*e* shown in FIG. 1 and those shown in FIGS. 4-7B. However, one can appreciate that embodiments can include any number of interchangeable wall units 110, each different in design and/or function.

FIG. 3 further shows that, in at least one embodiment, wall frame 305 can include one or more mounting holes 205 for easy mounting of wall frame 305 to a wall or structure. FIG. 3 also shows that mounting hole 205 has a screw installed for purposes of illustration. In addition, FIG. 3 shows that wall frame 305 comprises a similarly configured design space 105 to those of FIG. 2, wherein depression 210 provides a lever or fulcrum for removal and insertion of a planar surface of a corresponding wall unit 110. Embodiments of wall frame 305 can also include channels/grooves 215, 217 at upper and lower ends of design space 105, as described in connection to FIG. 2.

Figure 4:
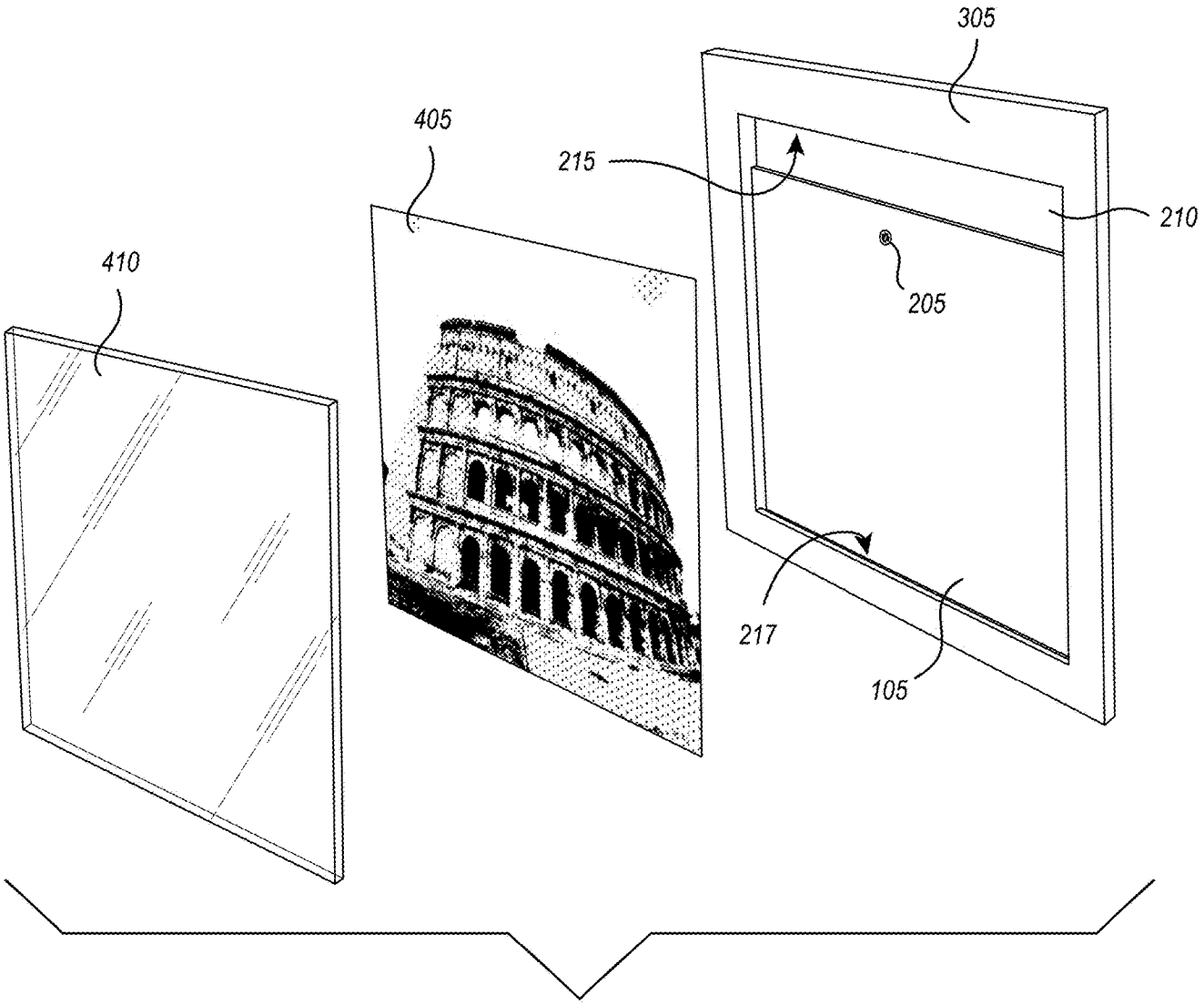
FIG. 4 illustrates an exploded, front perspective view of a reconfigurable wall panel with a printed image and a clear panel according to one or more embodiments of the present disclosure.

FIG. 4 illustrates an exemplary wall unit 110 comprising a printed photograph or image 405 and a transparent panel 410, each configured to fit within design space 105. Alternatively, an interchangeable wall unit 110*e* comprising a finishing panel of similar size and shape to transparent panel 410 can be installed within design space 105. As shown in FIG. 4, a user can first insert printed photograph or image 405 into design space 105, then secure and protect printed photograph or image 405 within design space 105 by inserting transparent panel 410 into grooves/channels 215, 217 of design space 105. Insertion and removal of transparent panel 410 into grooves/channels 215, 217 are enabled by the fulcrum and space provided by depression 210. The action of insertion and removal of panels and or wall units 110 is shown in more detail in FIGS. 9A-9B.

FIGS. 5A-7B illustrate various exemplary interchangeable wall units 110 that can be installed within a single design space 105. For purposes of illustration, each single-space wall unit is shown secured to wall frame 305 having a single design space 105. It should be appreciated, however, that any interchangeable wall unit 110 may be configured to coordinate with any design space 105, or any number of design spaces 105 as illustrated in FIGS. 8A-8B and 10A-10B, regardless of the number of design spaces 105 included on a particular reconfigurable wall panel.

Figure 5A:
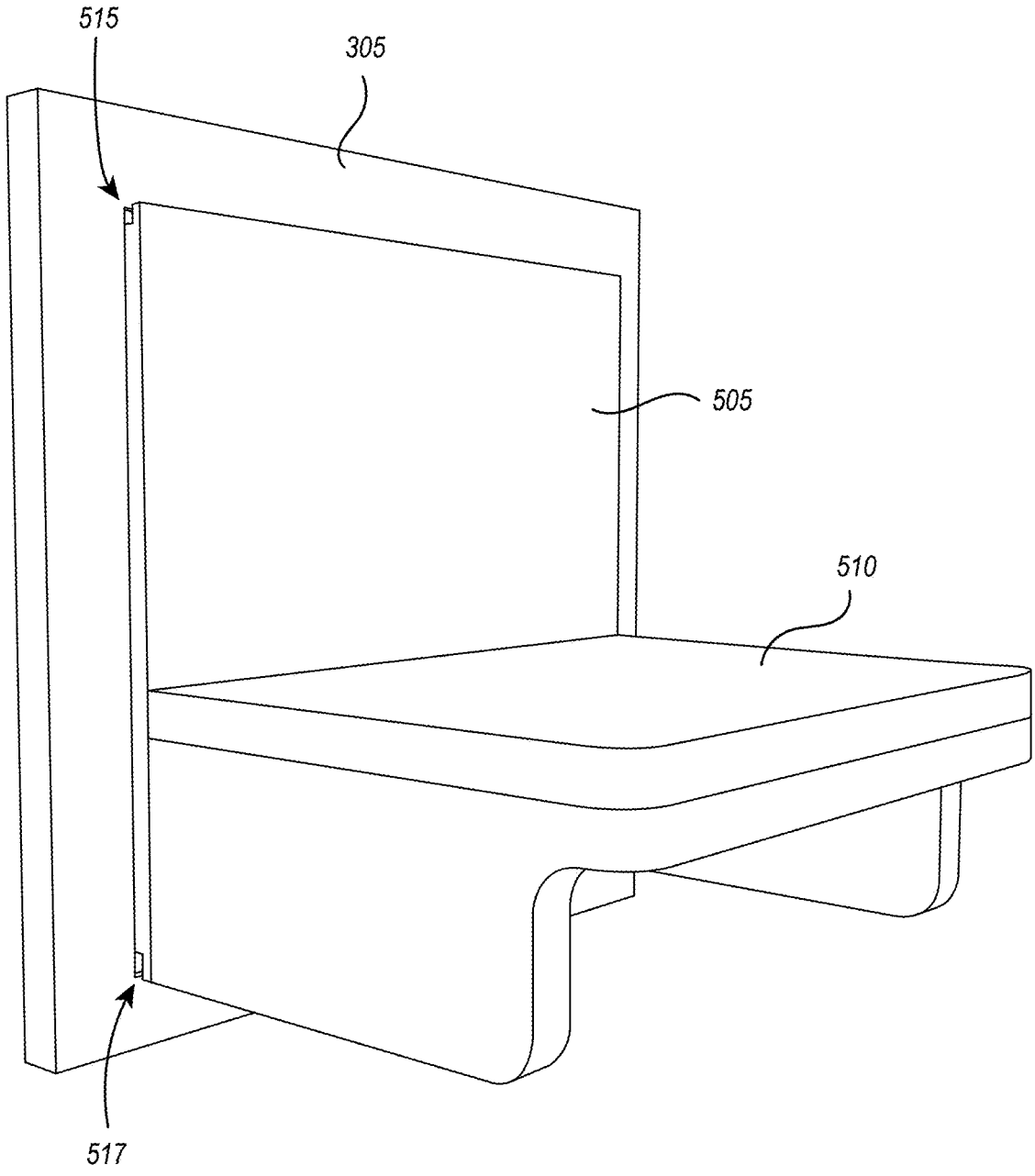
FIG. 5A illustrates a front perspective view of a reconfigurable wall panel with an interchangeable shelf unit detachably secured thereto according to one or more embodiments of the present disclosure.
Figure 5B:
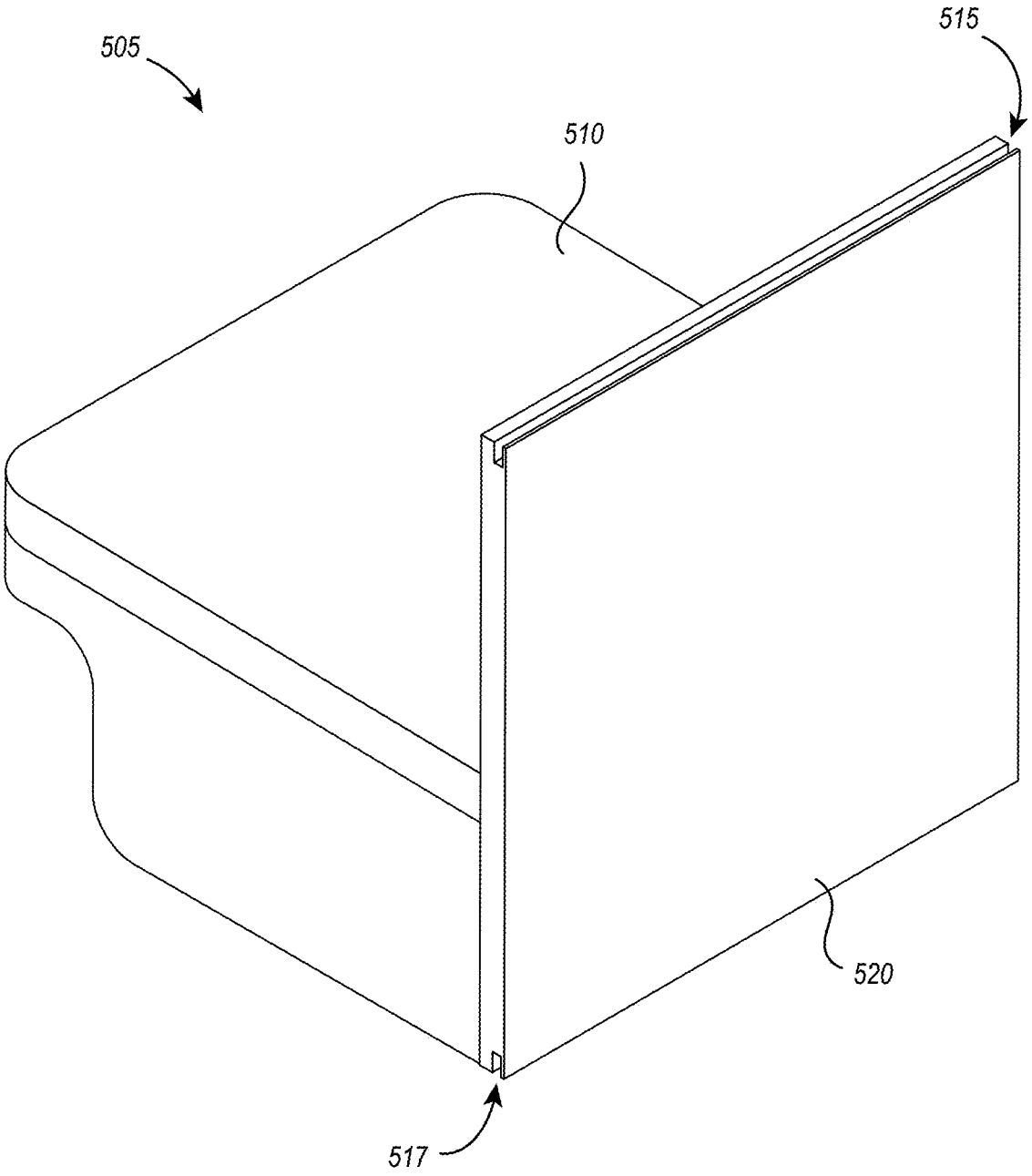
FIG. 5B illustrates a rear perspective view of the interchangeable shelf unit of FIG. 5A, as isolated from the wall panel.

FIGS. 5A-5B illustrate an exemplary embodiment of an interchangeable wall unit 505 comprising a shelf 510. In FIG. 5A, interchangeable wall unit 505 is shown secured to wall frame 305, with upper and lower edges 515, 517 of wall unit 505 corresponding to and coordinating with grooves/channels 215, 217 of design space 105. In some embodiments, wall unit 505 can be removed from design space 105, rotated and replaced, such that shelf 510 takes on a reversed configuration.

Figure 9A:
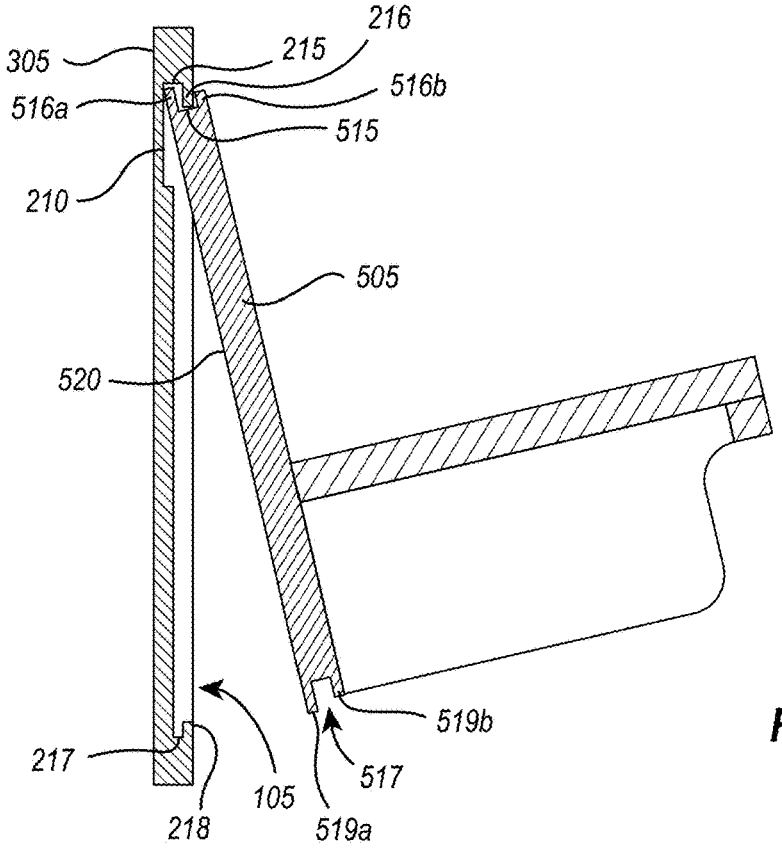
FIG. 9A illustrates a cross-sectional side view of a reconfigurable wall panel with an interchangeable shelf unit being mounted to the reconfigurable wall panel according to one or more embodiments of the present disclosure.

FIG. 5B shows a rear perspective view of interchangeable wall unit 505, wherein interchangeable wall unit 505 has been removed from design space 105. As shown, upper and lower edges 515, 517 are configured to correspond with the grooves/channels 215, 217 of any design space 105. Accordingly, interchangeable wall unit 505 can be reinstalled within a design space 105 by tilting a rear planar panel 520 to align upper edge 515 with upper groove/channel 215 of design space 105 as shown in FIG. 9A.

Figure 6A:
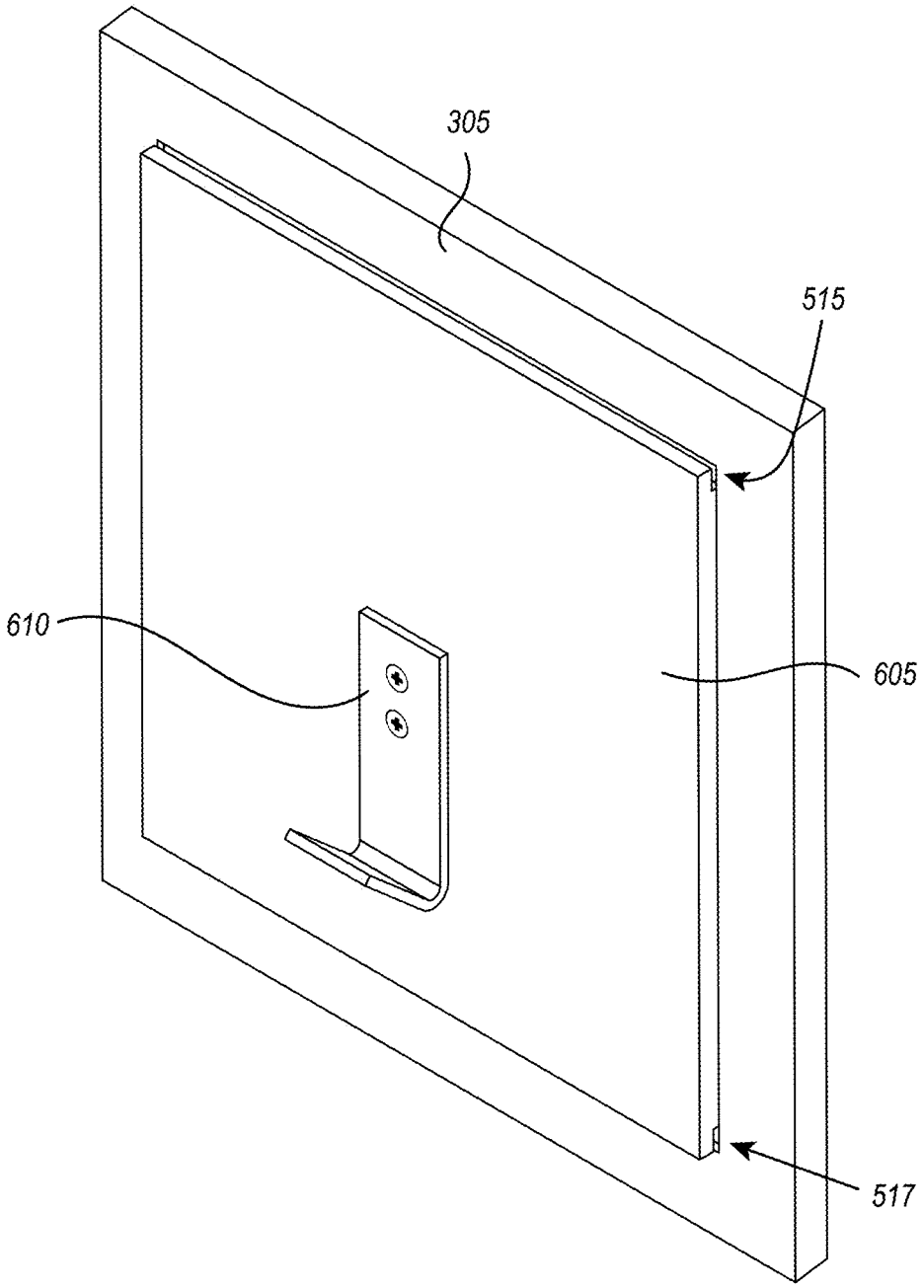
FIG. 6A illustrates a front perspective view of a reconfigurable wall panel with an interchangeable single hook unit detachably secured thereto according to one or more embodiments of the present disclosure.
Figure 6B:
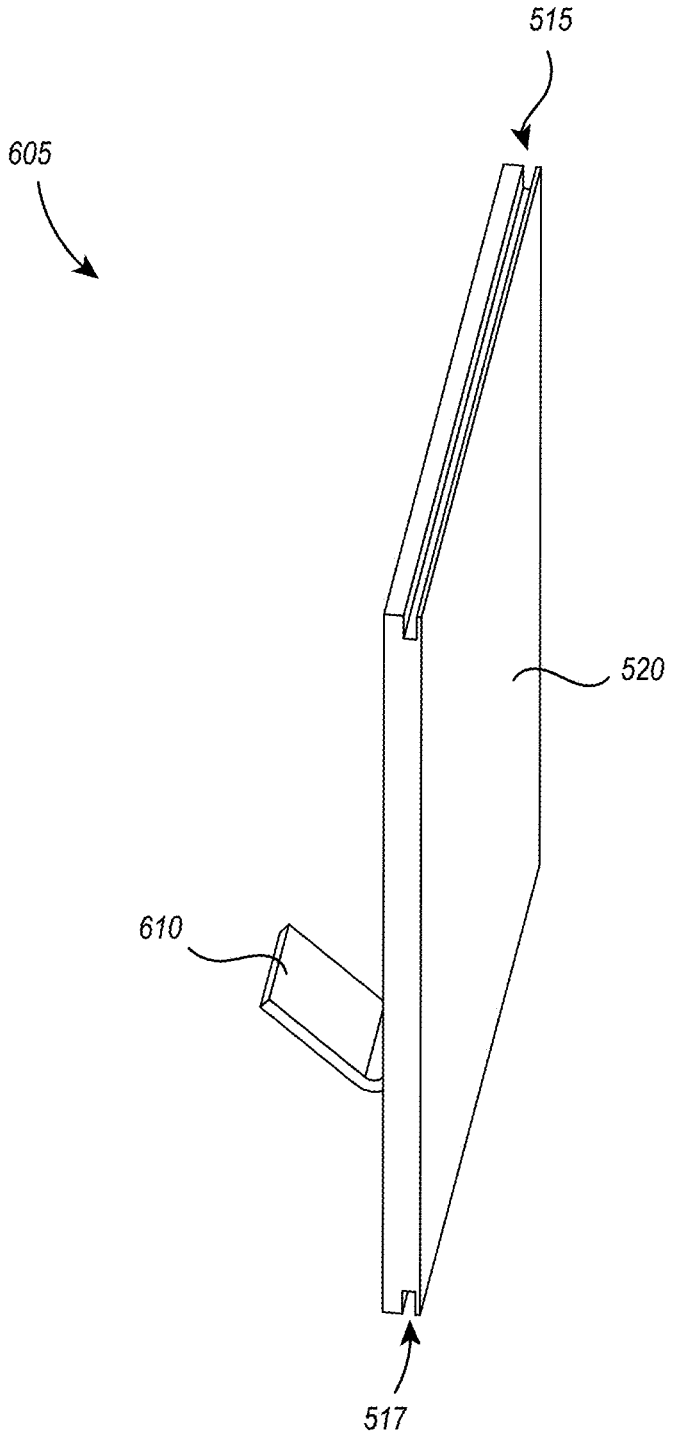
FIG. 6B illustrates a rear perspective view of the interchangeable single hook unit of FIG. 6A.

FIGS. 6A-6B illustrate an exemplary embodiment of an interchangeable wall unit 605 comprising a hook 610. In FIG. 6A, interchangeable wall unit 605 is shown secured to wall frame 305, with upper and lower edges 515, 517 of wall unit 605 corresponding to and coordinating with grooves/channels 215, 217 of design space 105.

FIG. 6B shows a rear perspective view of interchangeable wall unit 605, wherein interchangeable wall unit 605 has been removed from design space 105. As shown, upper and lower edges 515, 517 are configured to correspond with the grooves/channels 215, 217 of any design space 105. Accordingly, interchangeable wall unit 605 can be reinstalled within a design space 105 by tilting a rear planar panel 520 to align upper edge 515 with upper groove/channel 215 of design space 105 as shown in FIG. 9A.

Figure 7A:
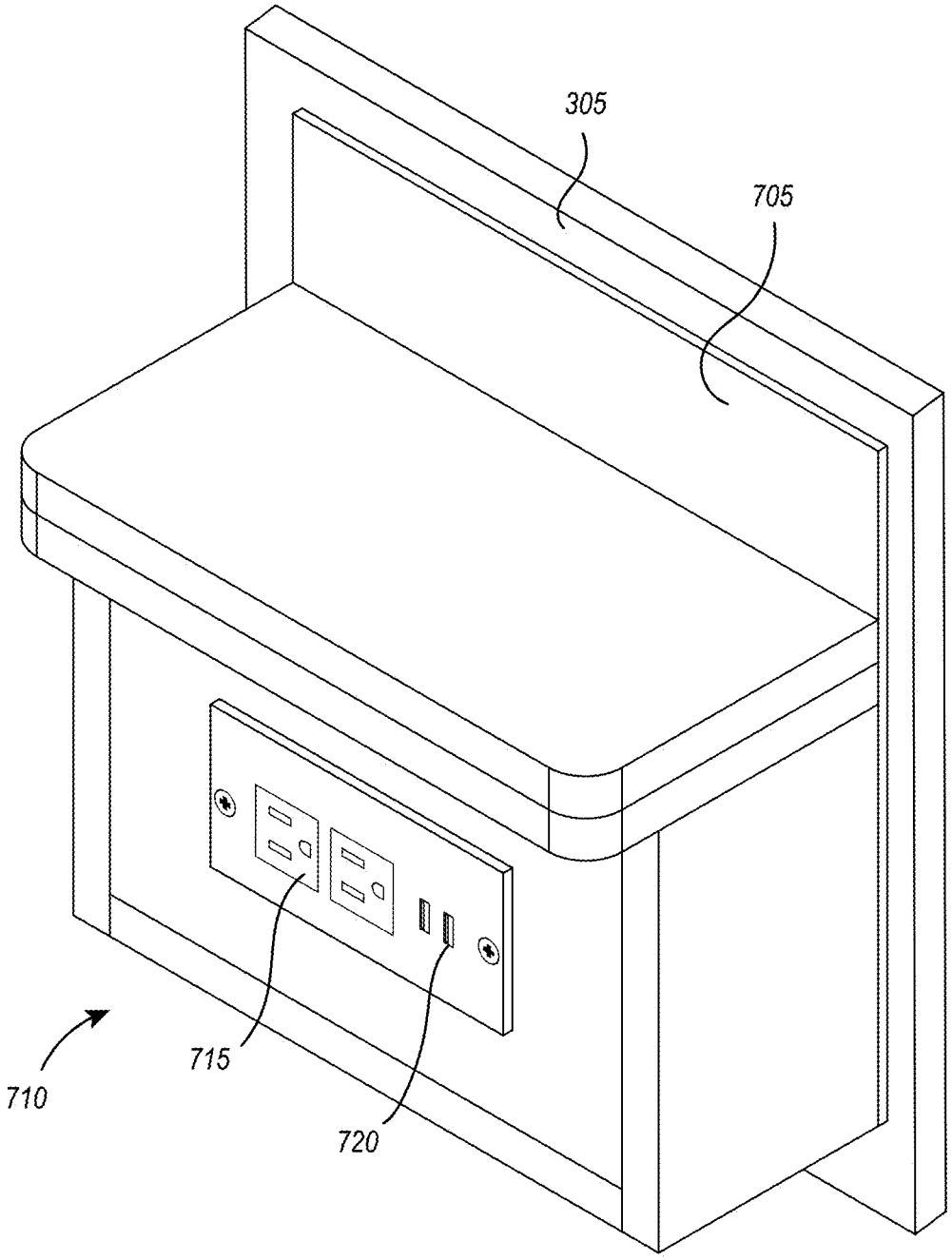
FIG. 7A illustrates a front perspective view of a reconfigurable wall panel with an interchangeable power hub unit detachably secured thereto according to one or more embodiments of the present disclosure.
Figure 7B:
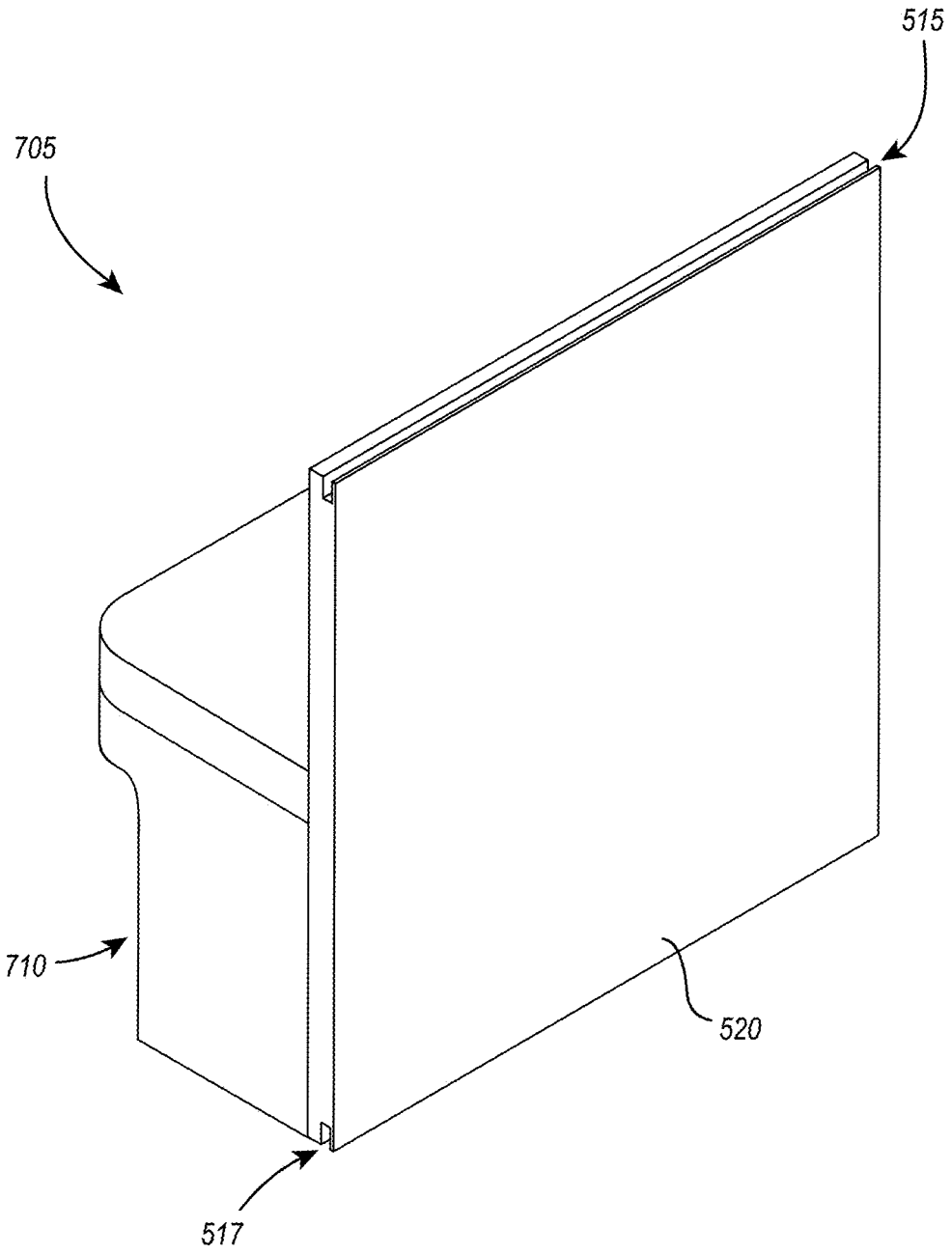
FIG. 7B illustrates a rear perspective view of the interchangeable power hub unit of FIG. 7A.

FIGS. 7A-7B illustrate an exemplary embodiment of an interchangeable wall unit 705 comprising a power hub 710. Embodiments of power hub 710 can include any number and combination of electric power and/or data source connections, such as but not limited to standard power outlets 715, USB ports 720, and so forth. In FIG. 7A, interchangeable wall unit 705 is shown secured to wall frame 305, with upper and lower edges 515, 517 of wall unit 705 corresponding to and coordinating with grooves/channels 215, 217 of design space 105.

FIG. 7B shows a rear perspective view of interchangeable wall unit 705, wherein interchangeable wall unit 705 has been removed from design space 105. As shown, upper and lower edges 515, 517 are configured to correspond with the grooves/channels 215, 217 of any design space 105. Accordingly, interchangeable wall unit 705 can be reinstalled within a design space 105 by tilting a rear planar panel 520 to align upper edge 515 with upper groove/channel 215 of design space 105 as shown in FIG. 9A.

Figure 8A:
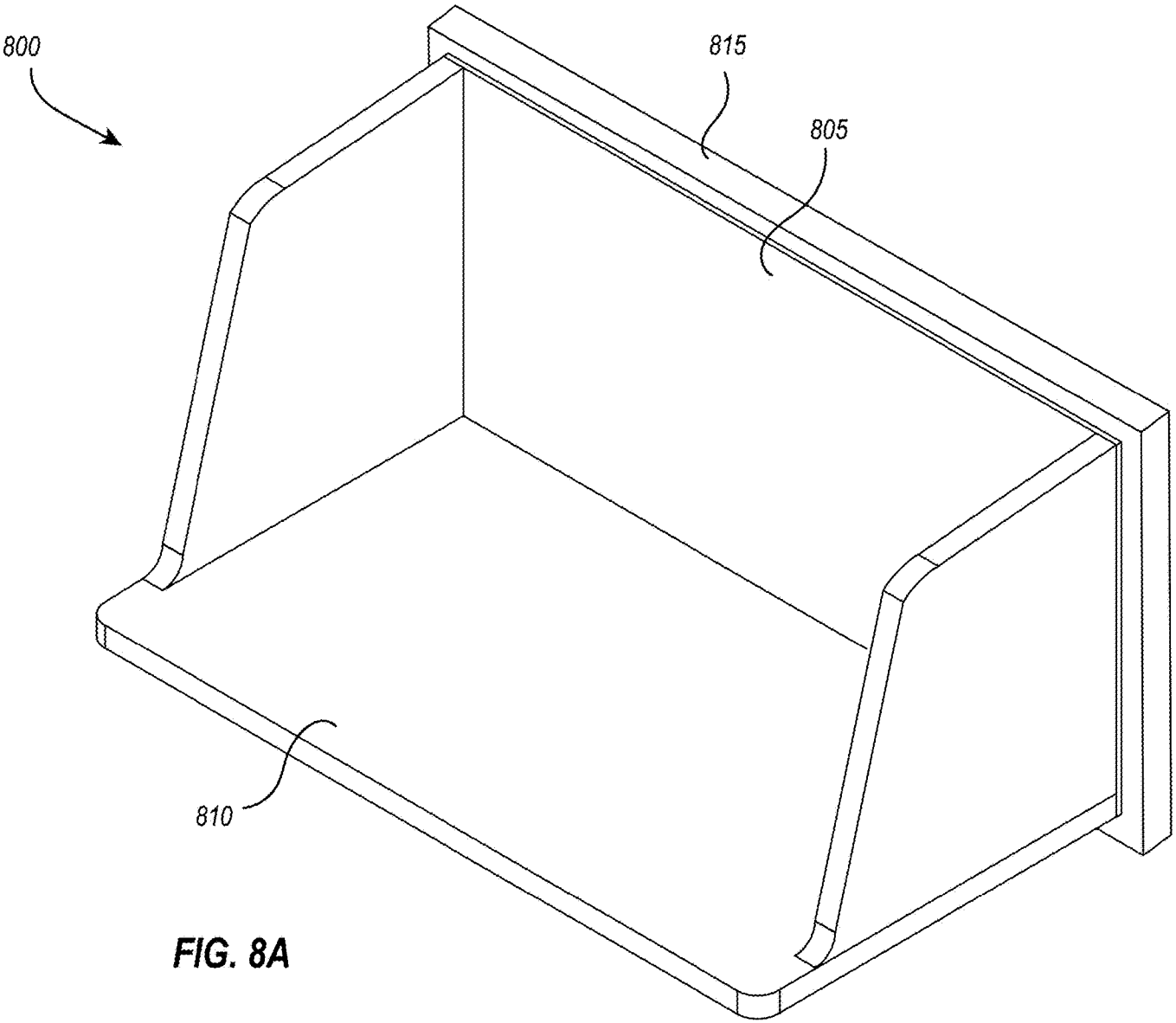
FIG. 8A illustrates a front perspective view of a reconfigurable wall panel having multiple design spaces with an interchangeable cross-module shelf unit detachably secured thereto according to one or more embodiments of the present disclosure.
Figure 8B:
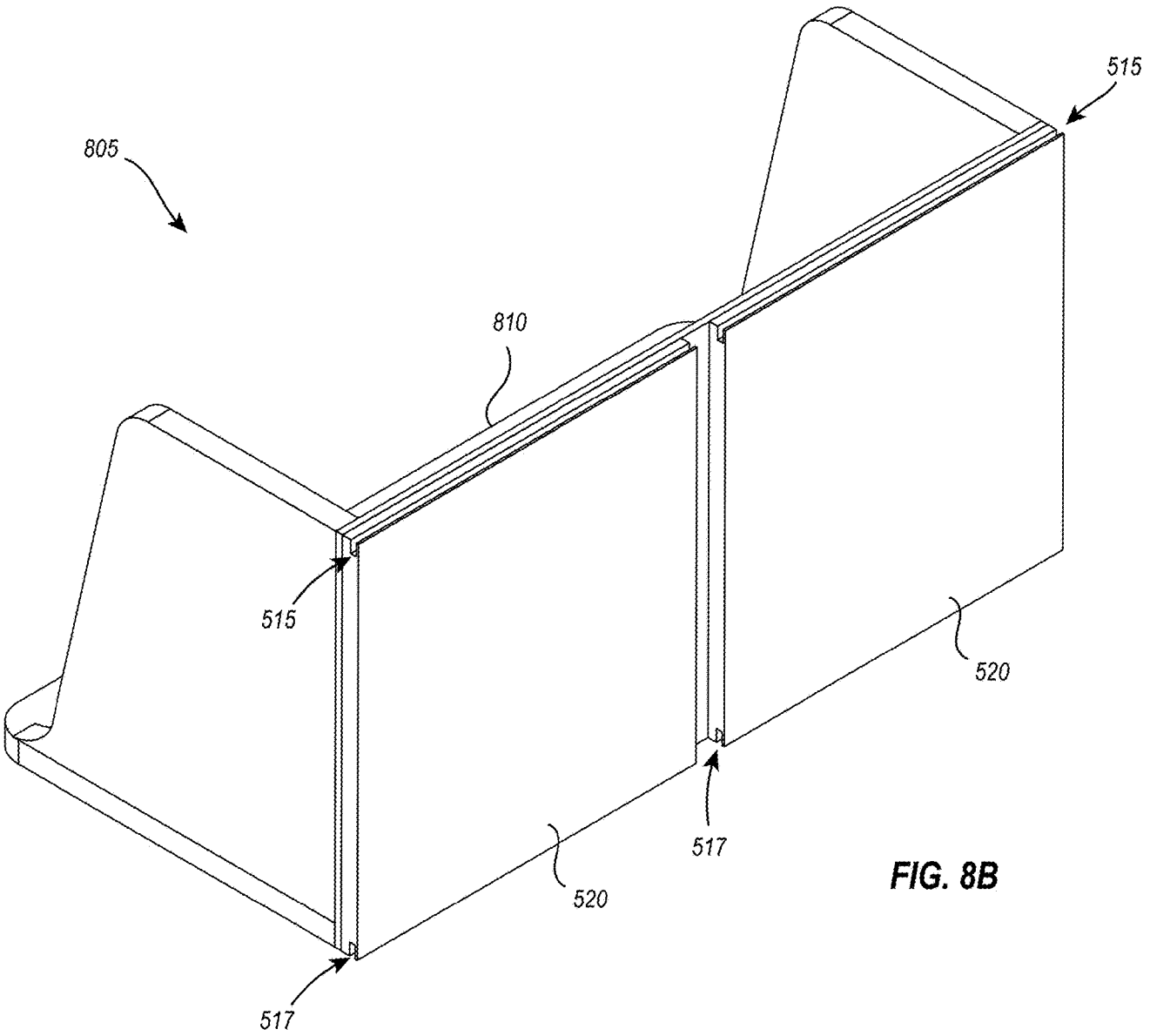
FIG. 8B illustrates a rear perspective view of the interchangeable cross-module shelf unit of FIG. 8A.

FIGS. 8A-8B illustrate an exemplary embodiment of a reconfigurable wall panel 800 having a cross-module interchangeable wall unit 805 comprising a shelf 810. In FIG. 8A, interchangeable wall unit 805 is shown secured to a wall frame 815 having two adjacent design spaces 105, with upper and lower edges 515, 517 of wall unit 805 corresponding to and coordinating with grooves/channels 215, 217 of two adjacent design spaces 105. While wall frame 815 is depicted as having exactly two design spaces 105, one should appreciate that interchangeable wall unit 805 can be secured to any wall frame having at least two adjacent design spaces 105. In some embodiments, cross-module interchangeable wall unit 805 can be removed from design spaces 105, rotated and replaced, such that shelf 810 takes on a reversed configuration.

FIG. 8B shows a rear perspective view of interchangeable wall unit 805, wherein interchangeable wall unit 805 comprises multiple shelves joined together, and has been removed from adjacent design spaces 105. As shown, upper and lower edges 515, 517 are configured to correspond with the grooves/channels 215, 217 of any two adjacent design spaces 105. Accordingly, interchangeable wall unit 805 can be reinstalled within a design space 105 by tilting the rear planar panels 520 shown to align upper edges 515 with upper grooves/channels 215 of two adjacent design spaces 105 as shown in FIG. 9A. Additionally, embodiments of wall unit 805 can include any number of rear planar panels 520 corresponding to any number of design spaces 105, such that shelf 810 can be virtually any size, depending on the number of adjacent design spaces 105 available for mounting wall unit 805.

Figure 9B:
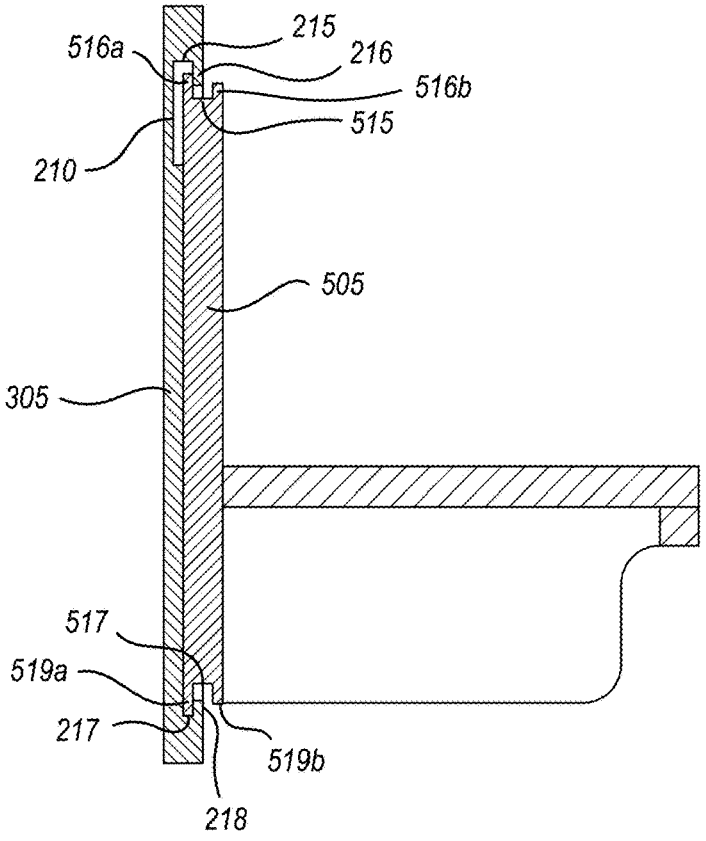
FIG. 9B illustrates a cross-sectional side view of the reconfigurable panel and interchangeable shelf unit of FIG. 9A with the interchangeable shelf unit detachable mounted according to one or more embodiments of the present disclosure.

FIGS. 9A-9B illustrate exemplary embodiments of mechanisms and methods for installing and removing interchangeable wall units 110 within a design space 105 according to the present disclosure. While the embodiment illustrated comprises interchangeable wall unit 505, each interchangeable wall unit 110 of the present disclosure can be configured to fit and be installed/removed from design spaces 105 in a similar or identical manner. As illustrated, design space 105 can comprise depression 210, depression 210 enabling a fulcrum action in combination with opposing upper and lower grooves/channels 215, 217 for installation or removal of any interchangeable wall unit 110.

As shown in FIG. 9A, interchangeable wall unit 505 is titled forward (or rotated) and inserted into depression 210, such that upper edge 515 coordinates with groove/channel 215, allowing wall unit 505 to be pushed upwards to enable lower edge 517 to be positioned about lower groove/channel 217. Interchangeable wall unit 505 can then be dropped into place, as shown in FIG. 9B, wherein planar panel 520 is fully inserted into design space 105, thus securing interchangeable wall unit 505 to wall frame 305. As shown, depression 210 can extend directly into upper groove/channel 215 to provide additional space for interchangeable wall unit 505 to be tilted forward. Additionally, planar panel 520 can rest flush against a significant portion of design space 105 when installed therein, thus providing increased stability to interchangeable wall unit 505.

Removal of interchangeable wall unit 505 can be effectuated easily and rapidly by sliding wall unit 505 upward (and rotating forward) into groove/channel 215 until lower edge 517 is clear of groove/channel 217, then tilting wall unit 505 forward into depression 210 and sliding upper edge 515 downward until it is out of correspondence with upper groove/channel 215. FIG. 9B also illustrates that edges 515, 517 provide the added advantage of concealing grooves/channels 215, 217 from view when interchangeable wall unit 505 is installed.

For example, FIGS. 9A and 9B illustrate that upper and lower edges 515, 517 can partially define respective upper and lower channels of the wall unit 505, said channels bounded by opposed outside and inside ridges (516*a-b* and 519*a-b*, respectively), with the upper channel comprising edge 515 bounded by outer ridge 516*a* and inner ridge 516*b*, and the lower channel comprising edge 517 bounded by outer ridge 519*a* and inner ridge 519*b*. As illustrated, when interchangeable wall unit 505 is installed within design space 105, the outside edges opposite upper and lower ridges 516*a*, 519*a* insert within grooves/channels 215, 217, while facing ridges 216 and 218 of the grooves/channels 215, 217 align with the edges 515, 517. The inside ridges 516*b* and 519*b* of the channels 515, 517 of wall unit 505 conceal the facing ridges 216 and 218 of the grooves/channels 515, 517.

FIGS. 9A and 9B also illustrate that inside ridges 516*b*, 519*b* can be relatively shorter than corresponding outside ridges 516*a*, 519*a* of interchangeable wall unit 505. In at least one implementation, this can be done to increase the range of tilting possible when inserting or removing interchangeable wall unit 505, as particularly demonstrated in FIG. 9A.

In some embodiments, groove/channel 215 can have a greater vertical depth than that of groove/channel 217 in order to accommodate for sliding interchangeable wall unit 505 upward during installation and removal. For example, the vertical depth of upper groove/channel 215 can be between 0.10 inches to about 0.3 inches, or approximately 0.1875 inches, and that of the lower groove/channel can be between about 0.08 inches to about 0.2 inches, or approximately 0.125 inches.

In an exemplary embodiment, the planar face of design space 105 can have a depth of between about 0.15 inches to about 0.4 inches, or approximately 0.25 inches relative to the front surface of wall frame 305. Further, depression 210 can have a depth of between about 0.08 inches to about 0.25 inches, or approximately 0.125 inch relative to the planar face of design space 105, as well as a height of between about 0.5 inches to about 2 inches, or approximately one inch, from the fulcrum point to the inside of groove/channel 215. In this example, groove/channel 217 can have an inside thickness of between about 0.08 inches to about 0.25 inches, or approximately 0.125 inches, to allow for insertion of an edge 517 having a thickness of between about 0.04 inches to about 0.2 inches, or approximately 0.085 to 0.100 inches, without excess space for movement of edge 517 within groove/channel 217. Also, groove/channel 215 can have an inside thickness equal to the sum of the inside thickness of groove/channel 217 and the depth of depression 210, such that in this example the depth of groove/channel 215 is between about 0.15 inches to about 0.4 inches, or approximately 0.25 inches.

Figure 10A:
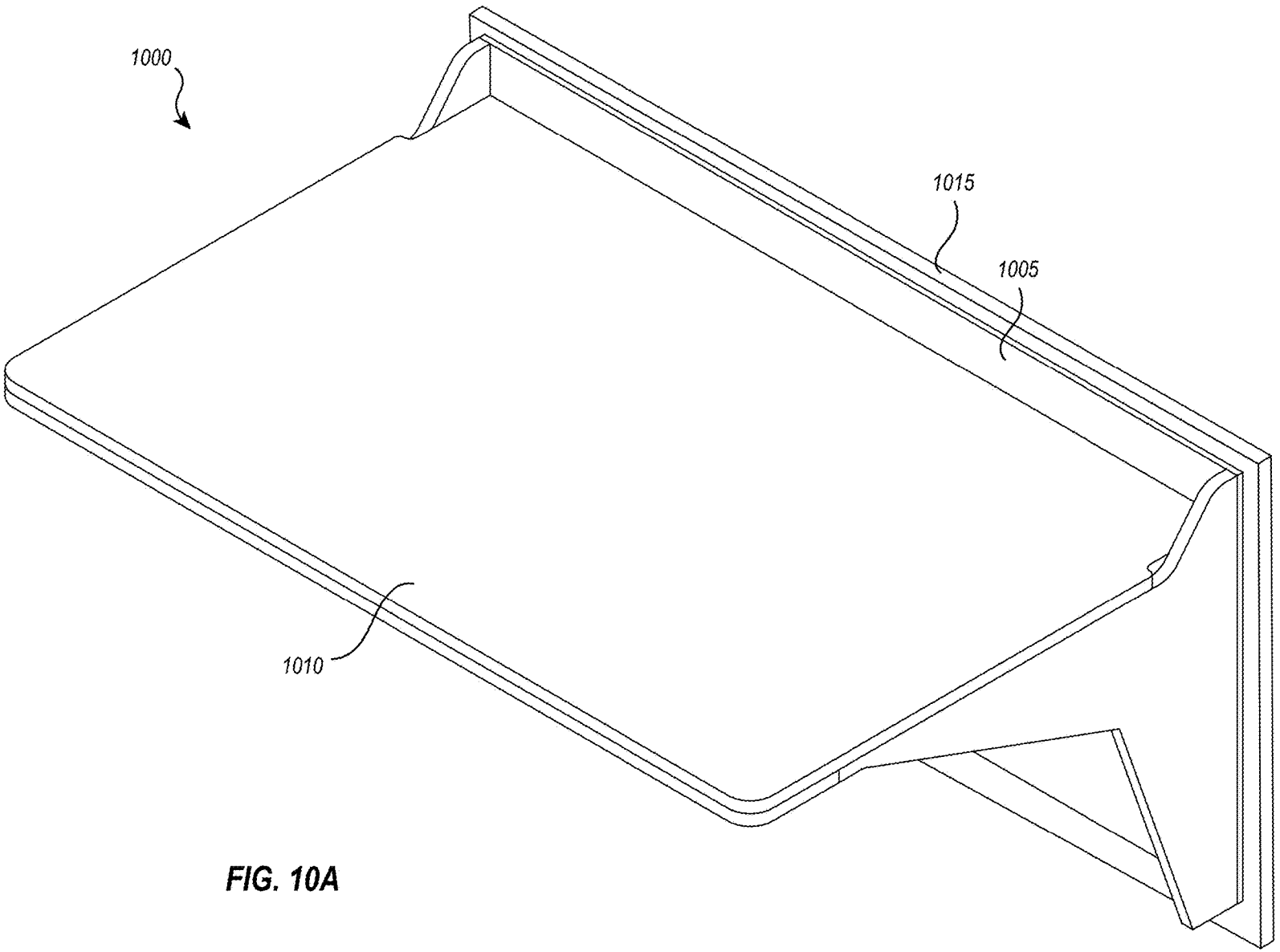
FIG. 10A illustrates a front perspective view of a reconfigurable wall panel having multiple design spaces with an interchangeable desk unit detachably secured thereto according to one or more embodiments of the present disclosure.
Figure 10B:
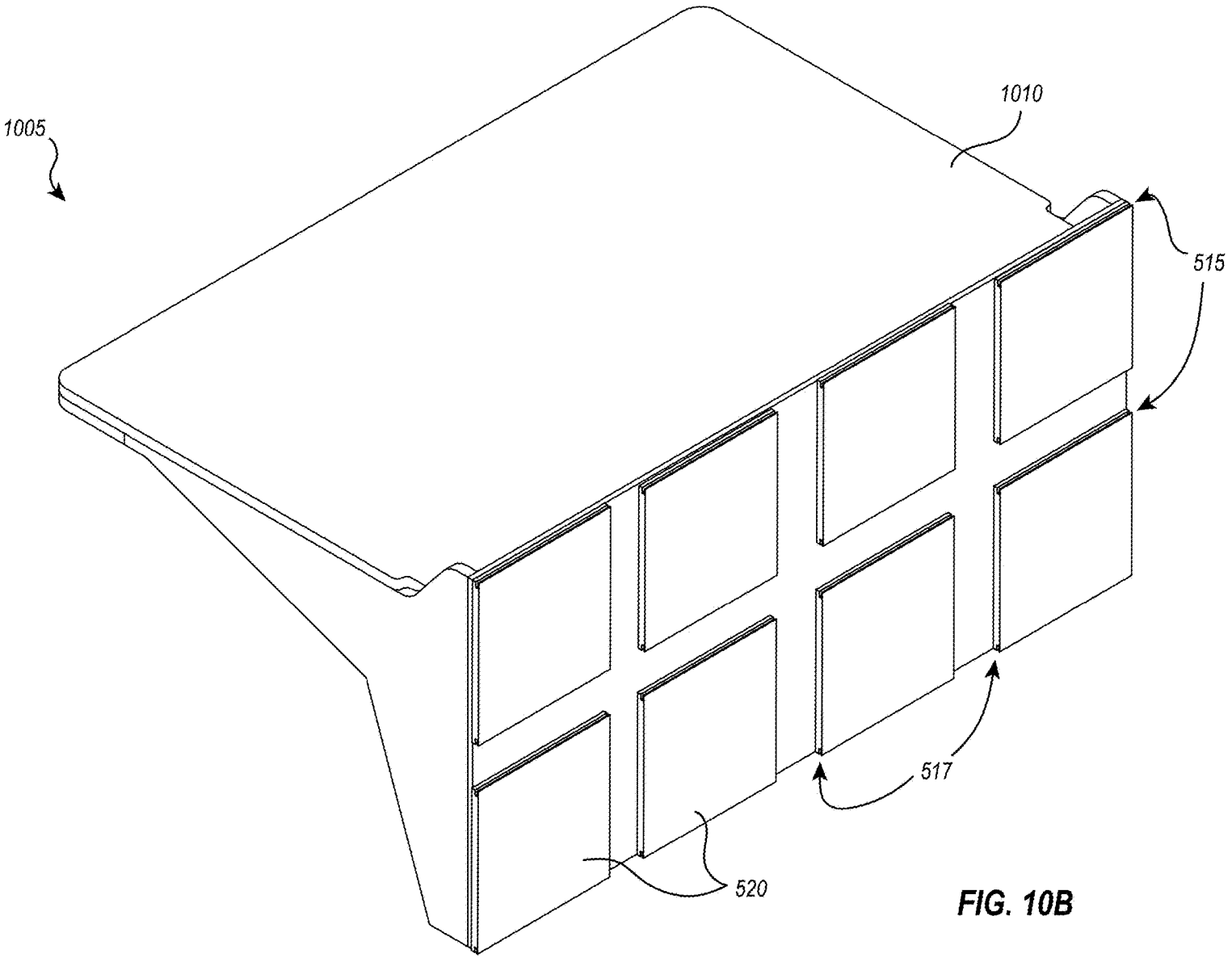
FIG. 10B illustrates a rear perspective view of the interchangeable desk unit of FIG. 10A.

FIGS. 10A-10B illustrate one or more exemplary embodiments of a reconfigurable wall panel 1000 having a cross-module interchangeable wall unit 1005 comprising a desk 1010. In FIG. 10A, interchangeable wall unit 1005 is shown secured to a wall frame 1015 having two adjacent rows of design spaces, each row having four adjacent design spaces 105 (i.e., eight design spaces 105 forming two rows and four columns), with upper and lower edges 515, 517 of wall unit 1005 corresponding to and coordinating with upper and lower grooves/channels 215, 217 of design spaces 105. While wall frame 1015 is depicted as having exactly eight design spaces 105, one should appreciate that interchangeable wall unit 1005 can be secured to any wall frame having at least eight adjacent design spaces 105 arranged in like manner. In some embodiments, cross-module interchangeable wall unit 1005 can be removed from design spaces 105, rotated and replaced, such that desk 1010 takes on a reversed configuration.

FIG. 10B shows a rear perspective view of interchangeable wall unit 1005, wherein interchangeable wall unit 1005 has been removed from design spaces 105. As shown, upper and lower edges 515, 517 are configured to correspond with the upper and lower grooves/channels 215, 217 of any eight design spaces 105 arranged in a corresponding configuration. Accordingly, interchangeable wall unit 1005 can be reinstalled within a set of design spaces 105 by tilting the rear planar panels 520 shown to align upper edges 515 with upper grooves/channels 215 of corresponding design spaces 105 as shown in FIG. 9A. Additionally, embodiments of wall unit 1005 can include any number of rear planar panels 520 corresponding to one or more of the design spaces 105 in a given wall frame. One will appreciate, however, that it is not necessary for there to be a 1:1 correlation between panels 520 and design spaces in the wall frame. One will also appreciate that features such as desk 1010 can be virtually any size, depending on the number of and arrangement of design spaces 105 available for mounting wall unit 1005, and how far across to the side, above, or below the manufacturer or end user desires the feature to span.

Figure 11B:
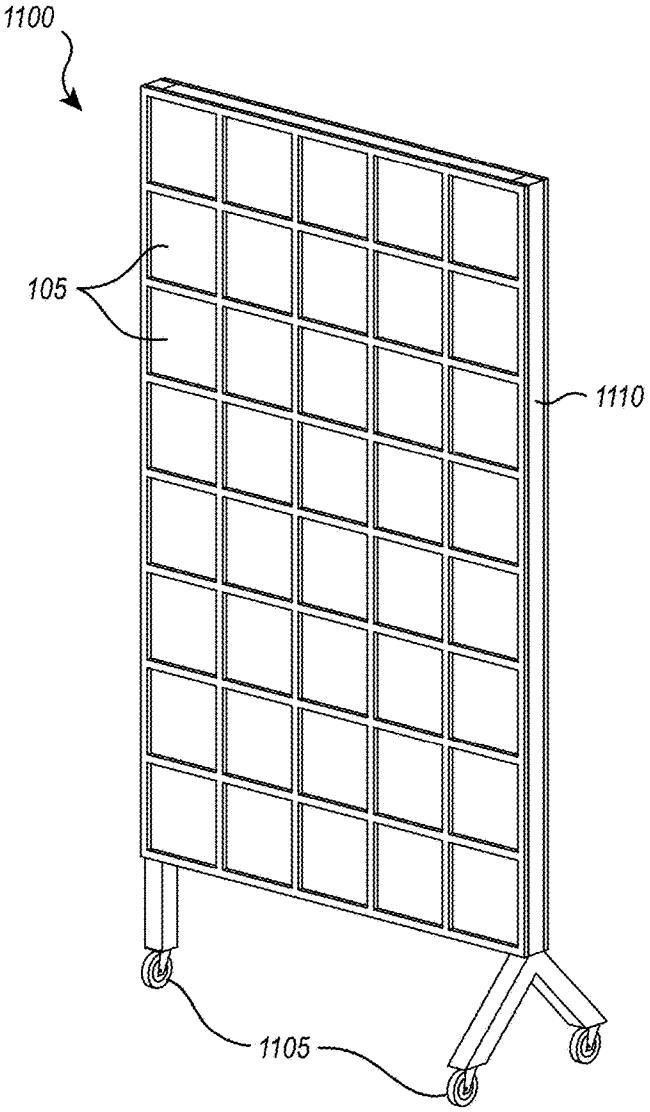
FIG. 11B illustrates a rear perspective view of the upright movable unit of FIG. 11A.
Figure 11A:
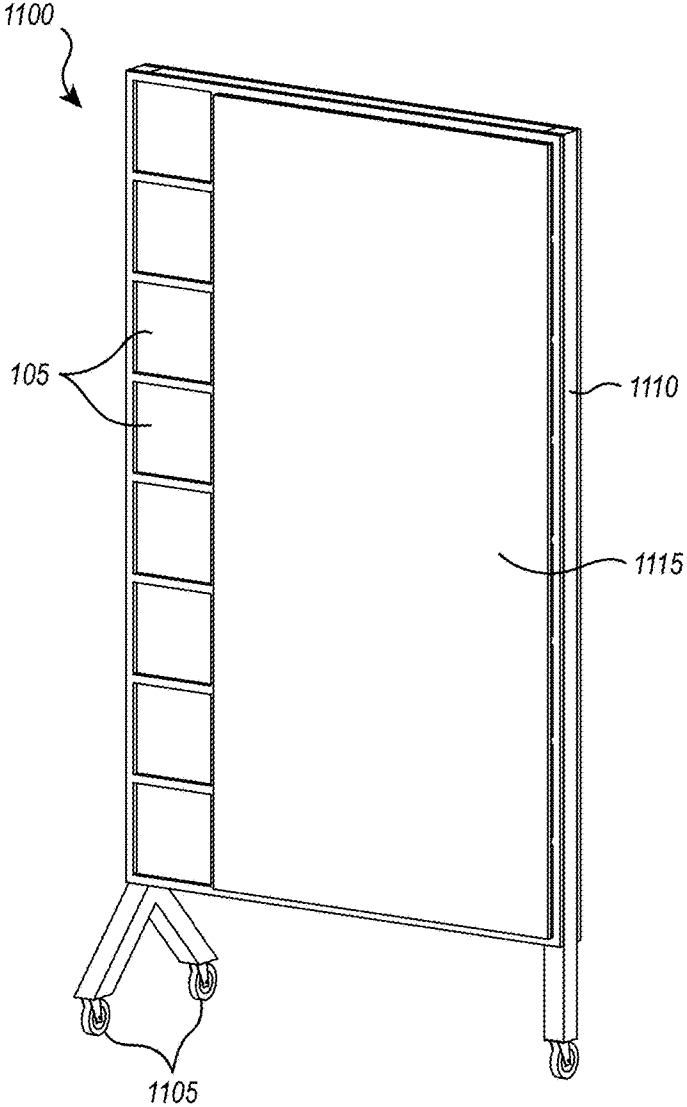
FIG. 11A illustrates a front perspective view of an upright movable unit with reconfigurable wall units according to one or more embodiments of the present disclosure.

Along these lines, FIGS. 11A-11B illustrate front and rear perspective views of an upright movable unit 1100 with a plurality of design spaces 105 for mounting interchangeable wall units 110, as well as a feature 1115 that spans a large number of the design spaces. For example, at least some embodiments of the present invention can comprise upright movable unit 1100 can include casters or wheels 1105. One or more reconfigurable wall panels according to the present disclosure can be mounted to upright movable unit 1100, resulting in a versatile system for organization and display that is also easy to move from point to point. As long as upright movable unit 1100 includes a structural frame 1110 of sufficient stability and strength, virtually any interchangeable wall unit 110 can be secured thereto. Also shown in FIG. 11A is a cross-module whiteboard unit 1115 spanning multiple design space 105.

Embodiments of the present disclosure can be offered to consumers and designers as individual components or, alternatively, as complete systems of kits comprising a wall frame with any number of design spaces 105 and a plurality of interchangeable wall units 110.

Figure 12:
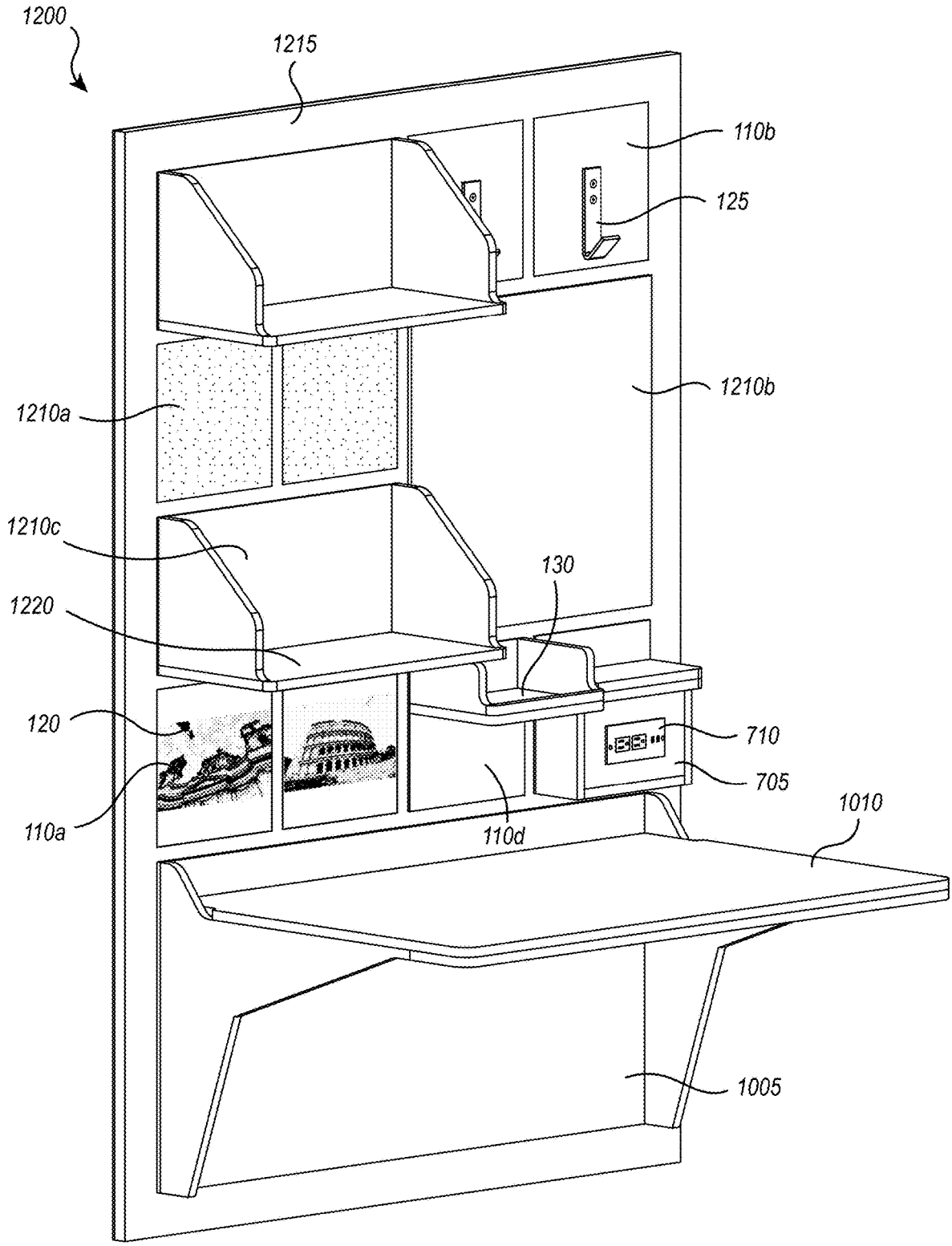
FIG. 12 illustrates a front perspective view of a reconfigurable workstation with multiple design spaces and various interchangeable wall units according to one or more embodiments of the present disclosure.

For example, FIG. 12 illustrates a reconfigurable workstation 1200 that can be provided as individual components or as a complete or partial kit. Embodiments of reconfigurable workstation 1200 can include a wide range of interchangeable wall units 110. As illustrated, FIG. 12 shows a reconfigurable workstation 1200 that includes a wall frame 1215 with twenty-four design spaces 105. FIG. 12 also shows that the wall frame 1215 can also comprise a reconfigurable workstation kit having: one or more interchangeable wall units 110*b* having a hook 125, one or more interchangeable wall units 110*a* displaying a photographic image 120, one or more interchangeable wall units 110*d* having a shelf 130, one or more interchangeable wall units 705 with an integrated power hub 710, a cross-module interchangeable wall unit 1005 with a desk 1010, one or more interchangeable wall units 1210*a* comprising a corkboard, a cross-module interchangeable wall units 1210*b* comprising a whiteboard or chalkboard, and one or more cross-module interchangeable wall units 1210*c* having a shelf 1220 of greater size than that of shelf 130.

Embodiments of reconfigurable workstation 1200 can include any of a wide variety of interchangeable wall units 110, as well as any size or shape of wall frame 1215 with any number of design spaces 105 as disclosed herein. Further, embodiments of reconfigurable wall panel systems or kits can be offered that comprise a wide range of applications, such as but not limited to a general workshop, mechanics tool station and workbench, a craft center and workbench, a bicycle repair station, a kitchen or pantry organization panel, a retail product and advertisement display, and so forth.

Accordingly, one will appreciate that one of ordinarily skill in the art can vary the design spaces (and corresponding lever/fulcrum areas or depressions), interchangeable wall units and wall frames in multiple different ways to achieve a highly scalable, highly customizable look and feel to a wall design. One will appreciate that the designs depicted herein are exemplary and that the form can be changed in many different ways for a variety of different features to suit the end user. Embodiments of the present disclosure can also be incorporated for mounting existing items to a wall frame, such as, for example, by installing one or more planar panels to the back of a television or other appliance, the planar panels having upper and lower edges compatible with the design spaces of a wall frame, thus enabling the television or other appliance to be directly mounted to a reconfigurable wall panel according to one or more embodiments of the present disclosure.

One will appreciate in view of the present specification and claims that interchangeable wall units of the present disclosure can also be configured so that they are not required for use, necessarily with the given wall frame. In at least one embodiment, any or all of the interchangeable wall units herein (as well as any not specifically illustrated) can be configured for independent operation. For example, a user may employ an interchangeable wall unit in the form of a white board that inserts into one or multiple design spaces as the case may be. The user could take the white board and continue writing on the board at the user's desk, or at another location, and later continue to use the white board when mounted to a wall frame in one of the design spaces.

Furthermore, interchangeable wall units have a consistent mounting interface. For example, the edges shown throughout the Figures, and in particular comparing the edges of the various exemplary wall units illustrated in FIGS. 4-10B with the channels and grooves of the illustrated design spaces, such as shown in FIGS. 2-4 and 9A-9B, and elsewhere herein show consistent reciprocal mounting interfaces comprising planes that fit within grooves, or channels that fit within and about grooves or channels in the design space. As such, one will appreciate that a user can use an interchangeable wall unit, remove it from the one or more design spaces, and continue using it on another, separate wall frame with one or more other design spaces at another location. So long as the various locations have a wall frame with sufficiently available design spaces, the user can use interchangeable wall units at any corresponding location. Hence, embodiments of the present disclosure provide wide flexibility not only in terms of design but in terms of use and functionality across multiple usage areas.

The present disclosure may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. A reconfigurable wall panel comprising:

a wall frame having one or more design spaces, each design space comprising:

an upper channel; and a lower channel, wherein openings of the upper and lower channels of the design space are oriented toward each other; and a depression within the design space, the depression enabling a fulcrum action in combination with the upper and lower channels;

one or more interchangeable wall units configured to insert in the one or more design spaces, each interchangeable wall unit comprising:

an upper edge and a lower edge, each corresponding to the upper and lower channels of each design space, the interchangeable wall unit being configured in size and shape to tilt into the depression of each design space and slide into a position such that the upper and lower edges of the interchangeable wall unit cooperate with the upper and lower channels of each design space to removably secure the position of the interchangeable wall unit; and one or more facing features.

2. The reconfigurable wall panel of claim 1, wherein:

at least one of the one or more interchangeable wall units comprises a mounting panel corresponding in size and shape to the one or more design spaces, and the mounting panel defines the upper and lower edges of the at least one of the one or more interchangeable wall units.

3. The reconfigurable wall panel of claim 1, wherein at least one of the one or more interchangeable wall units includes a facing feature comprising a printed graphic, an image, or a photograph.

4. The reconfigurable wall panel of claim 1, wherein at least one of the one or more interchangeable wall units includes a facing feature comprising a hanging feature.

5. The reconfigurable wall panel of claim 1, wherein at least one of the one or more interchangeable wall units includes a facing feature comprising a shelf, a cabinet, or a set of one or more drawers.

6. The reconfigurable wall panel of claim 1, wherein at least one of the one or more interchangeable wall units includes a facing feature comprising a French cleat storage system.

7. The reconfigurable wall panel of claim 1, wherein at least one of the one or more interchangeable wall units includes a facing feature comprising a power hub having one or more electric ports.

8. The reconfigurable wall panel of claim 2, wherein the mounting panel of at least one of the one or more interchangeable wall units is configured to be secured to an existing appliance, such that the existing appliance can be removably secured to at least one of the one or more design spaces.

9. The reconfigurable wall panel of claim 1, wherein the upper and lower edges comprise upper and lower grooves that comprise openings that are oriented away from each other.

10. The reconfigurable wall panel of claim 1, wherein the upper channel or the lower channel is defined by at least three channel walls.

11. A reconfigurable wall panel system comprising:

one or more wall frames, each wall frame having one or more design spaces, each design space comprising:

opposing upper and lower channels; and a depression within the design space, the depression providing a fulcrum area that enables fulcrum action in combination with the opposing upper and lower channels to facilitate insertion or release of an interchangeable wall unit;

one or more interchangeable wall units configured to insert in the one or more design spaces, each interchangeable wall unit comprising:

opposing upper and lower edges corresponding to the upper and lower channels of each design space, the interchangeable wall unit configured in size and shape to tilt into the depression of each design space and slide into a position such that the opposing upper and lower edges of the wall unit cooperate with the opposing upper and lower channels of the design space to removably secure the position of the interchangeable wall unit; and one or more facing features.

12. The reconfigurable wall panel system of claim 11, wherein the one or more wall frames are configured to be secured to an existing wall or structure.

13. The reconfigurable wall panel system of claim 11, wherein the one or more wall frames are secured to an upright movable unit.

14. The reconfigurable wall panel system of claim 11, wherein at least one of the one or more interchangeable wall units is a cross-module wall unit configured to span two or more adjacent design spaces.

15. The reconfigurable wall panel system of claim 14, wherein the cross-module wall unit comprises a desk or a shelf.

16. The reconfigurable wall panel system of claim 14, wherein the cross-moduli wall unit comprises a cabinet or a set of one or more drawers.

17. The reconfigurable wall panel system of claim 14, wherein the cross-module wall unit comprises multiple facing features.

18. The reconfigurable wall panel system of claim 11, wherein the fulcrum area is provided within one of the opposing upper or lower channels.

19. The reconfigurable wall panel system of claim 11, wherein the upper channel is wider than the lower channel, and wherein the depression defines at least one channel wall of the upper channel.

20. The reconfigurable wall panel system of claim 11, wherein the design space comprises planar surface positioned at a first depth relative to a front surface of the wall frame, and wherein the depression is positioned at a second depth relative to the planar surface of the design space.

* * * * *